US008756730B2

(12) United States Patent
MacDonald

(10) Patent No.: US 8,756,730 B2
(45) Date of Patent: Jun. 24, 2014

(54) ZIPPERED BEDDING

(75) Inventor: Jennifer MacDonald, Burbank, CA (US)

(73) Assignee: MacCarron Industries, Inc., Burbank, CA (US)

( * ) Notice: Subject to any disclaimer, the term of this patent is extended or adjusted under 35 U.S.C. 154(b) by 0 days.

(21) Appl. No.: 13/417,574

(22) Filed: Mar. 12, 2012

(65) Prior Publication Data

US 2012/0167306 A1 Jul. 5, 2012

Related U.S. Application Data

(63) Continuation of application No. 12/419,947, filed on Apr. 7, 2009, now abandoned.

(51) Int. Cl.
*A47G 9/02* (2006.01)

(52) U.S. Cl.
CPC ..... *A47G 9/02* (2013.01)
USPC ..... 5/488; 5/482; 5/494; 5/495; 5/496; 5/497; 5/498; 5/499; 5/500; 5/501; 5/502

(58) Field of Classification Search
USPC ..... 5/482, 488, 494–502
See application file for complete search history.

(56) References Cited

U.S. PATENT DOCUMENTS

| | | | |
|---|---|---|---|
| 3,241,161 | A | 3/1966 | Dashosh et al. |
| 4,241,466 | A | 12/1980 | Mendyk |
| 4,304,018 | A | 12/1981 | McClam |
| 4,413,368 | A | 11/1983 | Schuetze |
| 5,003,655 | A | 4/1991 | Kafai |
| 5,208,927 | A | 5/1993 | Lachmar |
| 5,244,278 | A | 9/1993 | Robitaille |
| 5,566,411 | A | 10/1996 | Eiler |
| 6,098,219 | A | 8/2000 | Milber |
| 6,243,895 | B1 | 6/2001 | Amin |
| 6,490,741 | B1 | 12/2002 | Wheeler |
| 6,651,278 | B2 | 11/2003 | Ghanem |
| 6,886,197 | B1 | 5/2005 | Madigan |
| 7,806,080 | B2 | 10/2010 | Morse |
| 7,818,833 | B2 | 10/2010 | Ewing |
| 2003/0177579 | A1 | 9/2003 | Diak/Ghanem |
| 2006/0053553 | A1 | 3/2006 | Gomeh |
| 2009/0044337 | A1 | 2/2009 | McKee |
| 2009/0293195 | A1 | 12/2009 | McGrath et al. |

*Primary Examiner* — William Kelleher

(74) *Attorney, Agent, or Firm* — Marc E. Hankin; Kevin Schraven; Jimmy Sauz

(57) ABSTRACT

The invention is a bedding apparatus, to be used with a conventional mattress. The bedding's bottom layer is fitted, so as to fit snugly around a mattress. The bottom layer is connected to the top layer by an attachment device, preferably two zippers. The top layer extends over three edges of the bottom layer, so as to appear aesthetically pleasing and provide comfort to the user. The zippers allow a user to easily and quickly make up the bed after sleeping in the bedding. It also functions to keep the top layer from falling off of the bed while sleeping and facilitates the user in weekly changing of the bed.

7 Claims, 6 Drawing Sheets

ZIPPERED BEDDING

CROSS-REFERENCE TO RELATED APPLICATIONS

This Application is a Continuation of U.S. Non-Provisional patent application Ser. No. 12/419,947, filed on Apr. 7, 2009, now abandoned entitled "Zippered Bedding", by inventor Jennifer MacDonald, the contents of which are expressly incorporated herein by this reference, and to which priority is claimed.

TECHNICAL FIELD

The present invention relates generally to bedding and more specifically relates to a bedding apparatus designed to fit snugly over a mattress, and provide the user with a top bedding cover that's attached to a bottom bedding cover, via zippers. This helps the top cover stay comfortably in place, during sleep, and facilitates the user in the daily bed making and weekly bed changing.

BACKGROUND

Conventional bedding typically consists of a mattress pad, a fitted sheet, a flat sheet, a comforter and/or a blanket. While a user is sleeping, he or she may kick the top coverings (flat sheet, comforter, and/or blanket) off the bed, resulting in an uncomfortable chill, or the monopolization of the top covering from another sleeping user, resulting in an unpleasant night of sleep or lack thereof. After waking up, the user may be in a hurry to leave, and consequently may leave an unmade and unsightly bed. Even if the user has time to make the bed, adjusting the lower coverings and top coverings may prove too burdensome and time-consuming for daily bed-making. The problem of making a bed is exacerbated when a user's bed is directly against a wall, or of a particularly high or low height.

Several inventions have attempted to remedy these problems, including, U.S. Pat. No. 5,208,927, issued to Lachmar, which discloses a bed-roll type bedding apparatus comprising a contoured top sheet, a bottom sheet and a blanket. However, the Lachmar apparatus is more like a sleeping bag for a conventional mattress and, in so doing, confines the user on three edges, as with a sleeping bag. In securing the foot end of the bedding, the Lachmar apparatus does not allow the user the freedom to move his or her feet.

Similarly, U.S. Pat. No. 4,413,368, issued to Schuetze, discloses a combination bedspread and sleeping enclosure that imprisons the user's feet at a closed foot end. Further, Schuetze does not teach a top cover that extends over the sides of the bed, thus making the bedding look substantially different from conventional bedding. Finally, the fastening means of the Schuetze apparatus are exposed to the user, resulting in additional discomfort and unsightliness.

U.S. Pat. No. 6,490,741, issued to Wheeler, discloses another zippered bed covering system with an upper cover, middle cover, and lower cover. However, Wheeler's single zipper is not concealed, and use of a single zipper means that the bedding does not fully envelop the user. Therefore, a co-user may still monopolize the covers while sleeping.

Thus, there is a need in the art for a bedding apparatus that is adaptable for multiple users, may be used with a conventional mattress, allows a user freedom from foot confinement, and also allows a user to easily and efficiently make the bed to look like conventional bedding is being used, thereby enhancing the appearance of the bed when not in use.

BRIEF SUMMARY OF THE INVENTION

The foregoing and other objects of the present bedding apparatus are accomplished by providing a bedding apparatus dimensioned, configured and arranged to be quickly fitted to a conventional mattress of any size.

One embodiment of the invention is a bedding apparatus, comprising: a top layer; a bottom layer; and a plurality of attachment devices. The bottom layer is comprised of a fitted portion and a top portion. The top portion of the bottom layer covers a top of a mattress, and the fitted portion of the bottom layer fits tightly around all sides of the mattress. The top layer extends over and beyond one or more edges of the top portion of the bottom layer. The plurality of attachment devices are preferably zippers. The zippers have a top slide rail and a bottom slide rail. The top slide rail of the zippers is attached to a bottom of the top layer; and the bottom slide rail of the zippers is attached to an outer surface of the top portion of the bottom layer. There are two zippers. The two bottom slide rails of the two zippers are essentially parallel and are located at opposing side edges of the top portion of the bottom layer; two bottom slide rails of the two zippers extend to a foot edge of the top portion of the bottom layer; and the two top slide rails of the two zippers are essentially parallel and are located on an interior of opposing side edges of the bottom of the top layer. The two zippers may be double-headed zippers. The top slide rails and the bottom slide rails of the zippers have a distal side and a proximal side, and wherein the proximal side has a lining that prevents a user's contact with a plurality of teeth of the zippers. This provides added comfort to the user when the zippers are zipped up. The top portion of the bottom layer is padded. The top layer of the bedding apparatus is preferably a lined comforter, a lined blanket, a blanket, or a comforter. The bedding apparatus looks like conventional bedding when assembled and made up.

In another embodiment of the invention, the bedding apparatus is comprised of a top layer and a bottom layer. The top layer functions to keep the user warm or covered while sleeping. The bottom layer acts as a padding on which the user sleeps, and as such, is configured to fit around a bed mattress like a mattress pad. The bottom and top layers are attached together by a connecting means, preferably a zipper. In this manner, the bottom layer fits over a mattress. The user will unzip the top layer from the bottom layer to enter the bedding. After entering, the user will zip up the top layer as far as the user pleases. After waking up, the user will unzip to get out of bed. To make the bed, the user simply, quickly, and efficiently zips up the apparatus. In one easy step, the user's bed is made.

To clean the bedding apparatus, the user may unzip the parts, or put the entire bedding unit into the washer and dryer. Furthermore, removing or replacing the bedding apparatus is facilitated because the bedding can be pulled off or put on as a single piece, whose bottom layer will form fit to a standard mattress.

Because the user may unzip the top layer from the bottom layer, completely, the user has the option of replacing the top layer with a heavier or lighter layer, depending on the season, the user's preference for warmth, or aesthetic concerns. Specifically, the top layer may be interchangeable with other zipper-able top layers that are heavier, lighter, or of a different shape, texture, or color.

The bedding may be made to fit any size bed, such as a California king, king, queen, full, double, twin, futon, RV or boat bed, or any other size of a bed. This allows both adults and children the opportunity to have a simply made-up bed.

A primary objective of this invention is to provide a bedding apparatus or bedding that reduces the amount of time and effort required to make and change a bed.

Another objective of this invention is to provide a bedding apparatus that will overcome the deficiencies found in the prior art.

Another objective of this invention is to provide a bedding apparatus for assisting in the making of a bed and securing the bedding onto a bed.

Another objective of this invention is to provide a bedding apparatus whereby a user's bed is conveniently, quickly, and easily made.

Another objective of this invention is to provide a bedding apparatus whereby the user's feet are free to hang over the bed and are not confined by a closure at the foot of the bed.

Another objective of this invention is to provide a bedding apparatus, which stays in place and is secure on a bed during the entire duration of a user's sleeping time.

Another objective of this invention is to provide a bedding apparatus, whose top layer may be replaced depending on a user's preference for warmth or style.

Another objective of this invention is to provide a bedding apparatus that may be utilized upon various sizes, shapes, and styles of beds.

Another objective of this invention is to provide a bedding apparatus wherein the fastening means are hidden and do not bother the user while the user sleeps.

These, as well as other components, steps, features, objectives, benefits, and advantages, will now become clear from a review of the following detailed description of illustrative embodiments, the accompanying drawings, and the claims.

BRIEF DESCRIPTION OF DRAWINGS

The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

DETAILED DESCRIPTION OF THE DRAWINGS

Illustrative embodiments are now discussed. Other embodiments may be used in addition or instead. Details that may be apparent or unnecessary may be omitted to save space or for a more effective presentation. Conversely, some embodiments may be practiced without all of the details that are disclosed.

Figure 1:
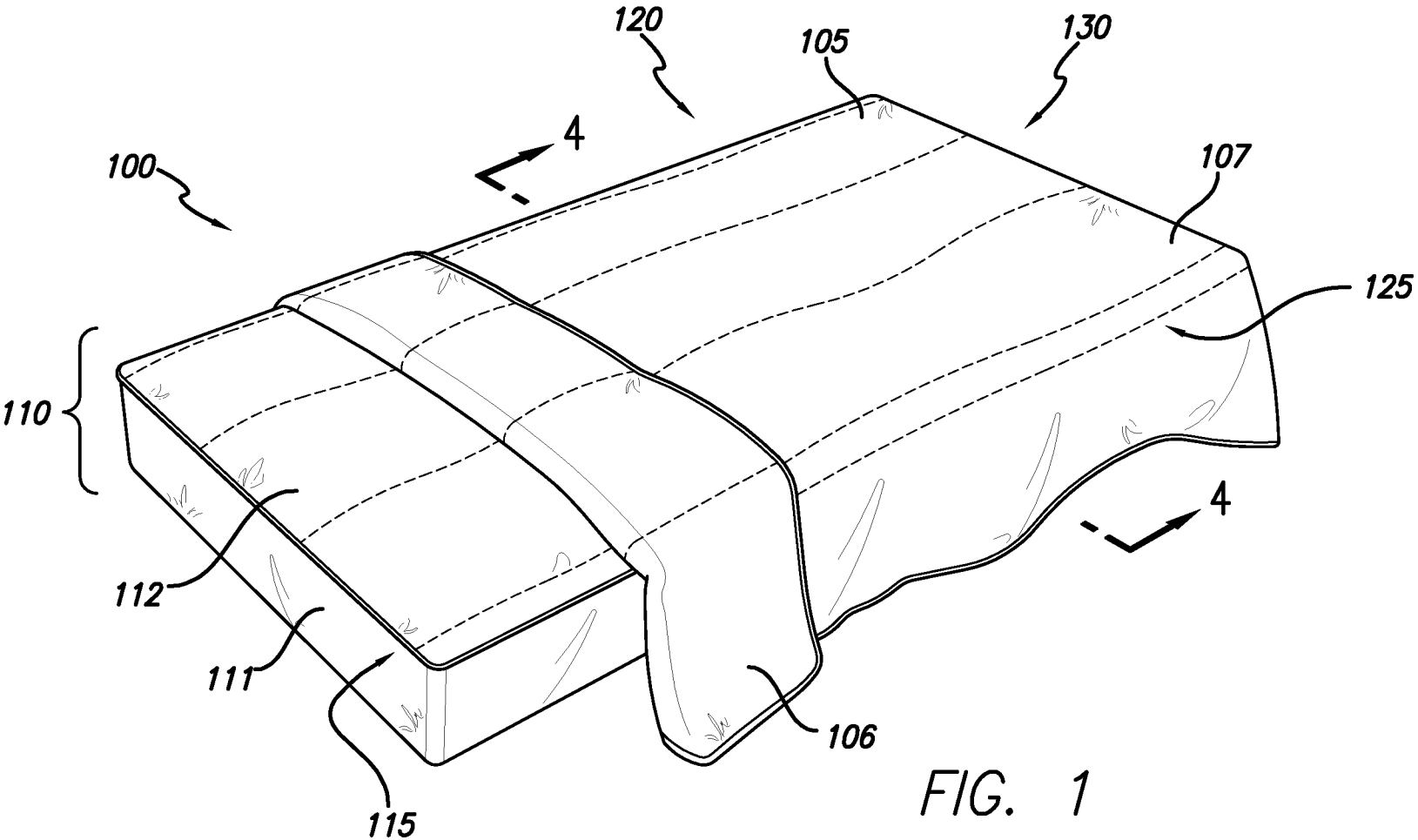
FIG. 1 is a top perspective view of one embodiment of the bedding apparatus and shows the bedding apparatus assembled and made up.

FIG. 1 is a top perspective view of one embodiment of the bedding apparatus and shows the bedding apparatus assembled and made up. The bedding apparatus 100 generally comprises a fitted bottom layer 110 and a flat top layer 105. The fitted bottom layer 110 is preferably comprised of a fitted portion 111 and a top portion 112. Fitted portion 111 fits around the sides of the mattress and tucks just underneath of the mattress, typically done with an elastic band at the ends of fitted portion 111. Top portion 112 covers the entire top side of a mattress. The fitted portion 111 is preferably a polyester, cotton, or polyester/cotton blend material. The top portion 112 is preferably multi-layered with an inner padding and a topside lining.

As shown in FIG. 1, the top layer 105 is preferably multi-layered with an inner padding. The top layer 105 of the bedding, which may be a comforter, a lined comforter, a blanket, a lined blanket, a sheet, or any other bed covering or fabric the user prefers for warmth and protection, extends to the top edge 115 of the mattress. The top layer 105 has an inner surface 106, which is preferably lined, and an outer surface 107. The top layer typically extends over the side edges of the mattress 120 and 125 and over the foot edge of the mattress 130. This conceals the attachment devices that of the bedding apparatus 100, and also provides warmth for the user's feet. The underside of the top layer 105 is attached to the top of the bottom layer 110 at the side edges 120 and 125, as shown in the figures below.

Figure 2:
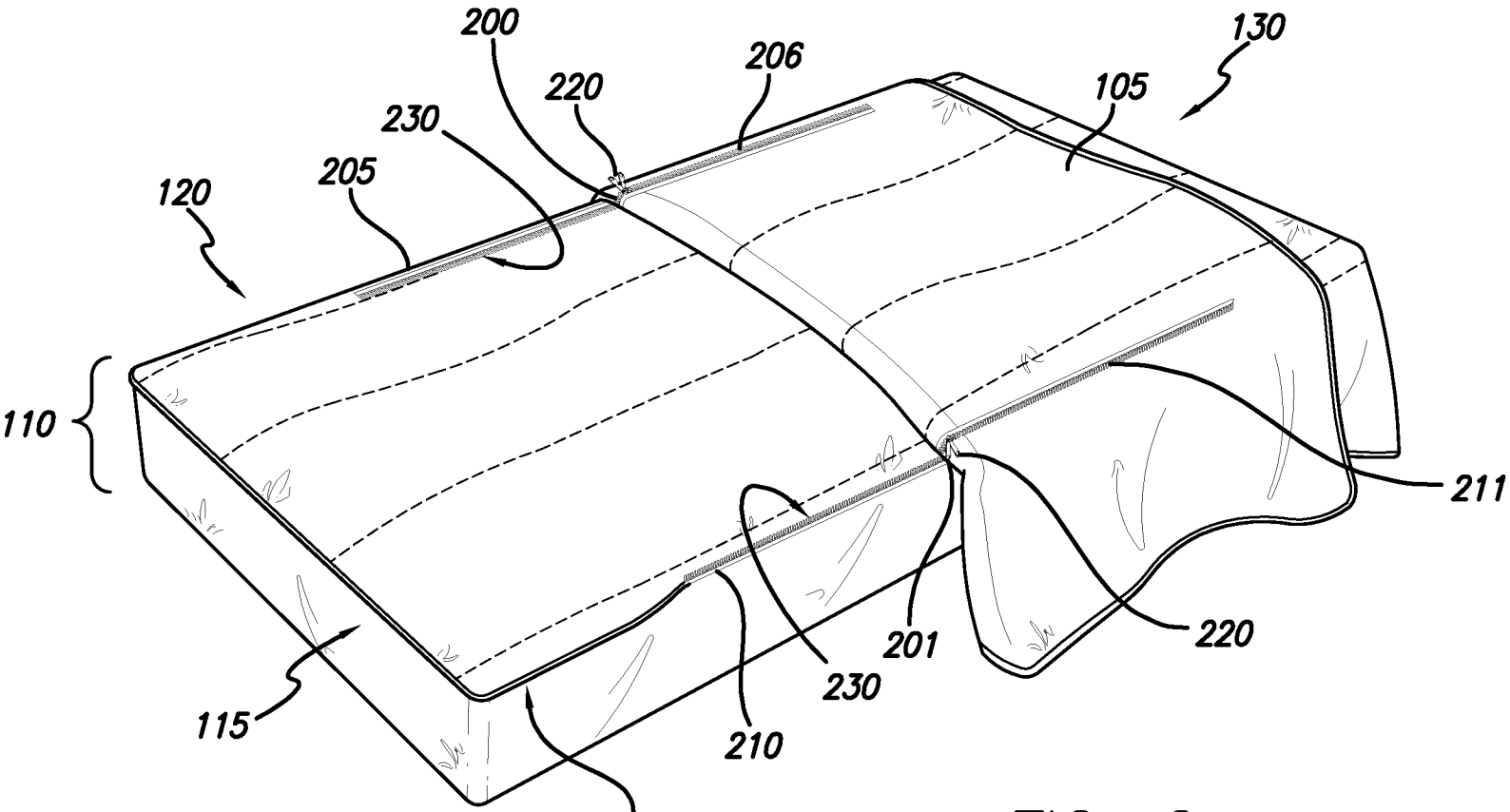
FIG. 2 is a top perspective view of one embodiment of the bedding apparatus with the top layer peeled back to show the zippers.

FIG. 2 is a top perspective view of one embodiment of the bedding apparatus with the top layer 105 peeled back to show the zippers. As shown in FIG. 2, the top layer 105 and bottom layer 110 are attached to each other with two zippers 200 and 201. The zippers have bottom slide rails 205 and 210 and top slide rails 206 and 211. Bottom slide rails 205 and 210 are attached to bottom layer 110 at the side edges 120 and 125. Top slide rails 206 and 211 are attached in the interior of the bottom surface of the top layer 105, wherein the sides of top layer 105 corner around the side edges 120 and 125. The zipper slide rails are typically attached to the bedding through stitching and/or fabric adhesive. The bottom slide rails 205 and 210 extend along the length of the side edges 120 and 125 from bottom edge 130 to a point short of top edge 115. This allows a user's head and feet to be appropriately covered, yet free from constraint. The zippers, as shown in FIG. 2, preferably have a lining 230 on the proximal, or inner, side of the rails. The lining is preferably a soft cotton flannel strip that runs the length of both rails of the zippers. This prevents the teeth of the zipper, when disassembled or assembled, from coming into uncomfortable contact with the user. FIG. 2 shows how the zippers are preferably double-headed, with two pull tabs 220, so that they may be zipped up or unzipped from the inside or outside of the bedding apparatus.

The user will sleep in the bedding by unzipping the zippers far enough for the user to pull back top layer 105, lay down on the bottom layer 110, and then zip the top layer 105 to a position that is comfortable for sleeping. The user typically places his feet near the bottom edge 130 and his head near the top edge 115. To make the bed after sleeping, the user, in one quick, easy step, will zip the top layer 105 fully from the side edges 120 and 125. In one fluid motion and with a minimum amount of time, the user will have an attractive and made up bed.

Figure 3:
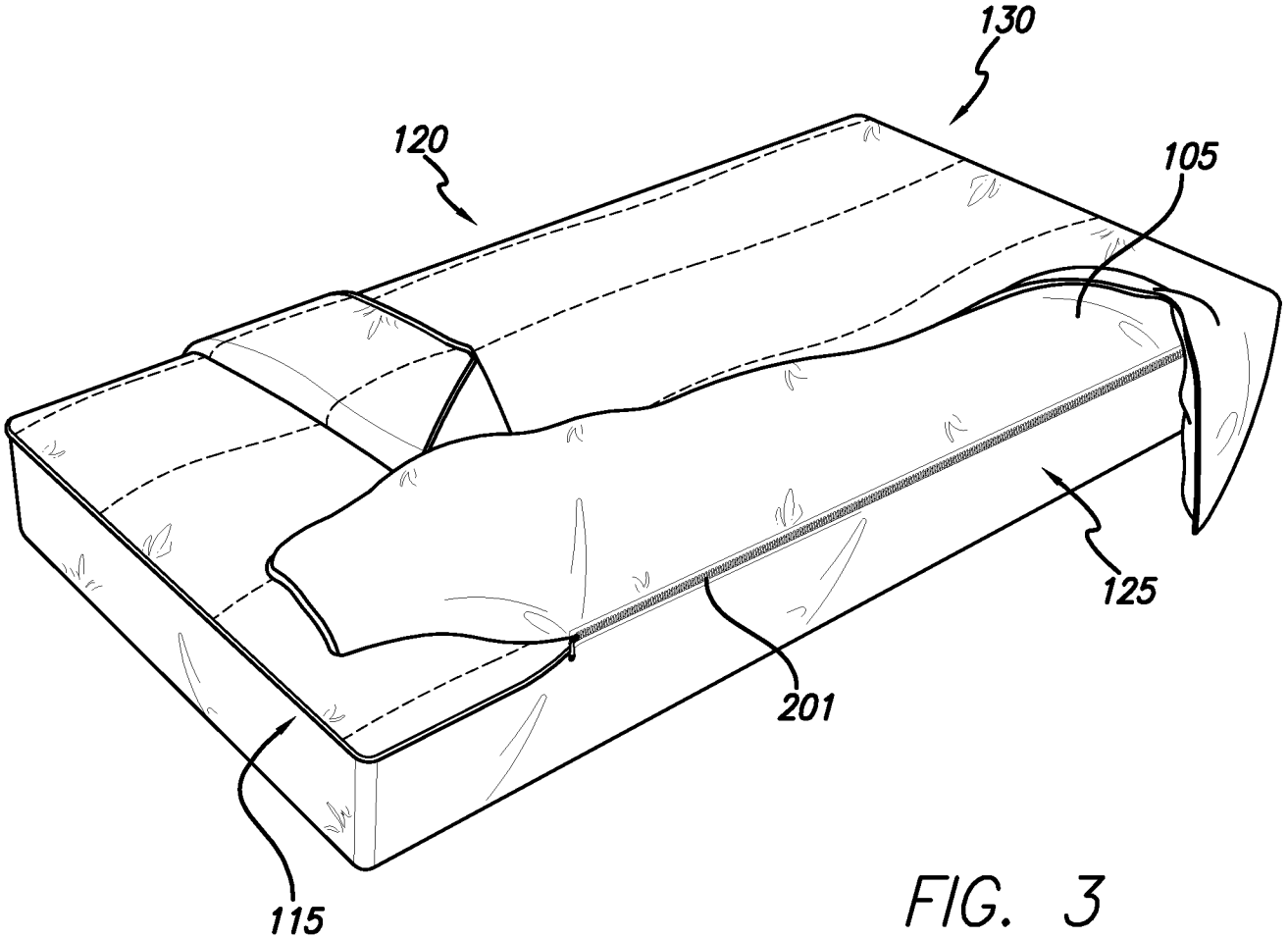
FIG. 3 is a top perspective view of one embodiment of the bedding apparatus with the top layer on one side folded up to show how the zipper connects the top layer and the bottom layer.

FIG. 3 is a top perspective view of one embodiment of the bedding apparatus with one side of the top layer folded up to show how the zipper connects the top layer and the bottom layer. As shown in FIG. 3, one side of top layer 105 has been folded up so that zipper 201 is visible. Zipper 201 is shown zipped up all the way. FIG. 3 shows how the side ends of the top layer 105 and the top and bottom ends of the top layer 105 extend beyond the zipper so that when the bed is made up, top layer 105 hangs over the bottom edge 130 and side edges 120 and 125, neither of the zippers would be visible. This was previously illustrated in FIG. 1. This allows a user to maintain a conventional, attractive and neatly made bed while the user is not sleeping inside. FIG. 3 also shows how the zippers begin at a distance below the top edge 115, and preferably extend all the way to the very end of bottom edge 130.

Figure 4:
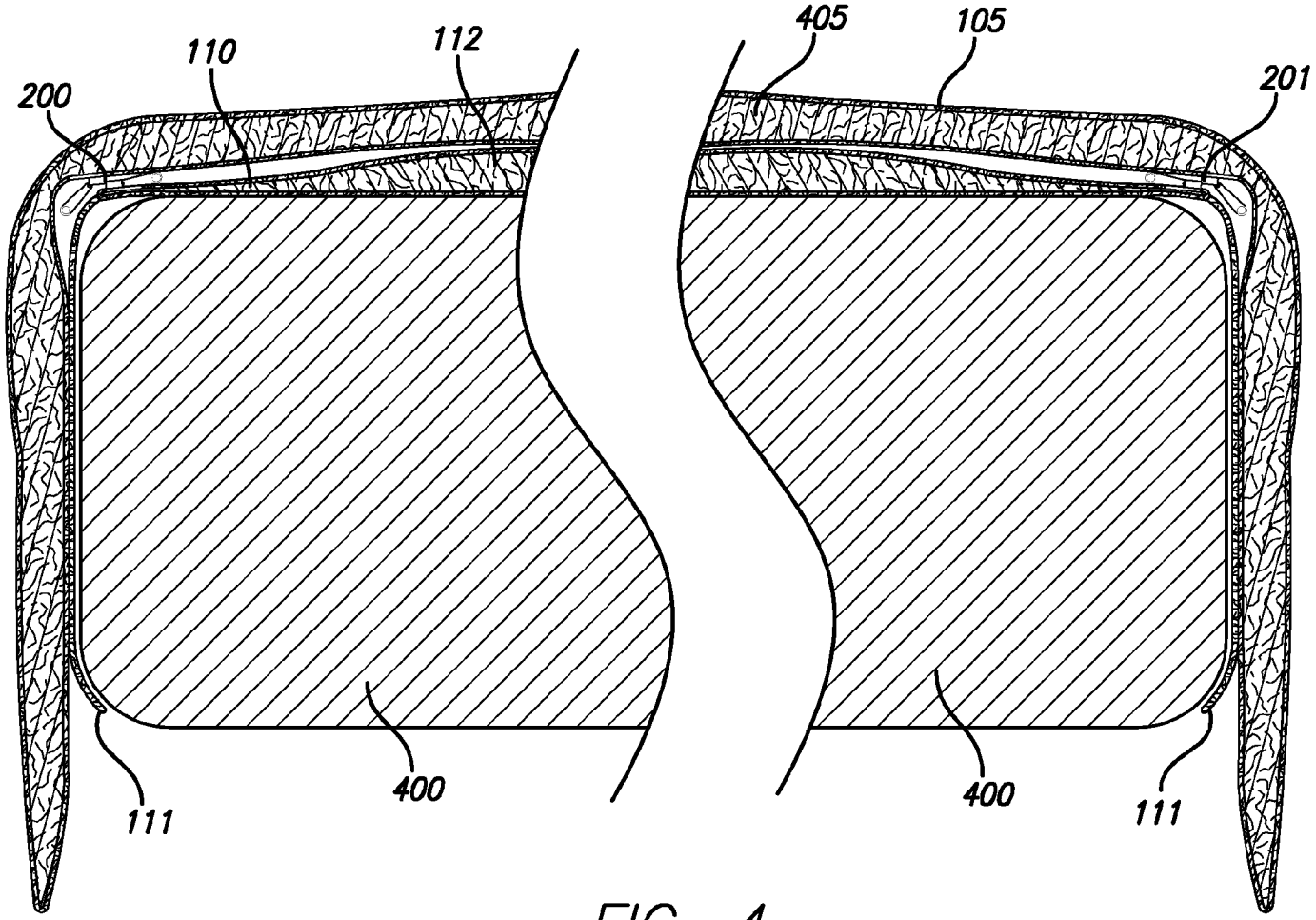
FIG. 4 is a cross-section view of one embodiment of the bedding apparatus on a mattress.

FIG. 4 is a cross-section view of one embodiment of the bedding apparatus on a mattress. As shown in FIG. 4, the bottom layer 110 has a fitted portion 111 that fits snugly around the mattress 400, and thus holds the bedding securely in place. The top portion 112 of bottom layer 110 is preferably layered and padded, as shown in FIG. 4. The top layer 105 is also shown with insulating, or padding material 405 for comfort and warmth. FIG. 4 shows how the top layer 105 fits over, and rests on, the bottom layer 110, and extends well over the sides of the mattress 400. FIG. 4 also shows that, when the bedding is made up, the top layer 105 and bottom layer 110 are connected by zippers 200 and 201.

Figure 5:
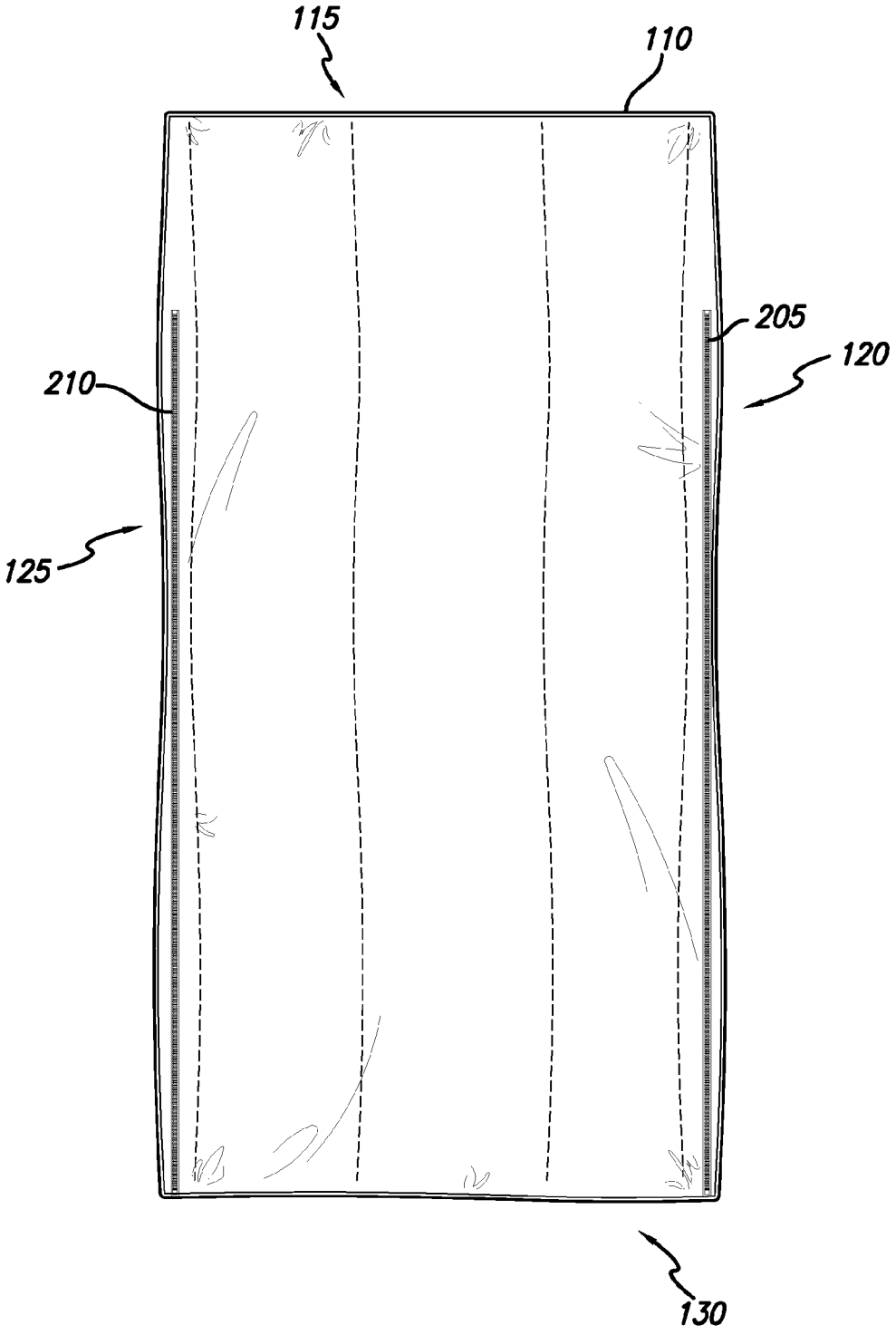
FIG. 5 is a top view of the bottom layer of one embodiment of the bedding apparatus.

FIG. 5 is a top view of the bottom layer 110 of one embodiment of the bedding apparatus. The top layer of the bedding is not shown in FIG. 5. As shown, the bottom slide rails 205 and 210 preferably run from a point interior to the top edge 115, along side edges 120 and 125 and all the way to bottom edge 130. This allows the user's head to be free from restriction. In an alternative embodiment, using a zipper with a dual-sided pull, which is two sets of double-headed zipper tabs on each of the two zippers, will allow the user to zip up or zip down as much as they prefer, so the top layer does not need to be zipped to the very ends of the bottom edge 130, nor does the top layer need to be zipped to the top of the zipper near the top edge 115.

Figure 6:
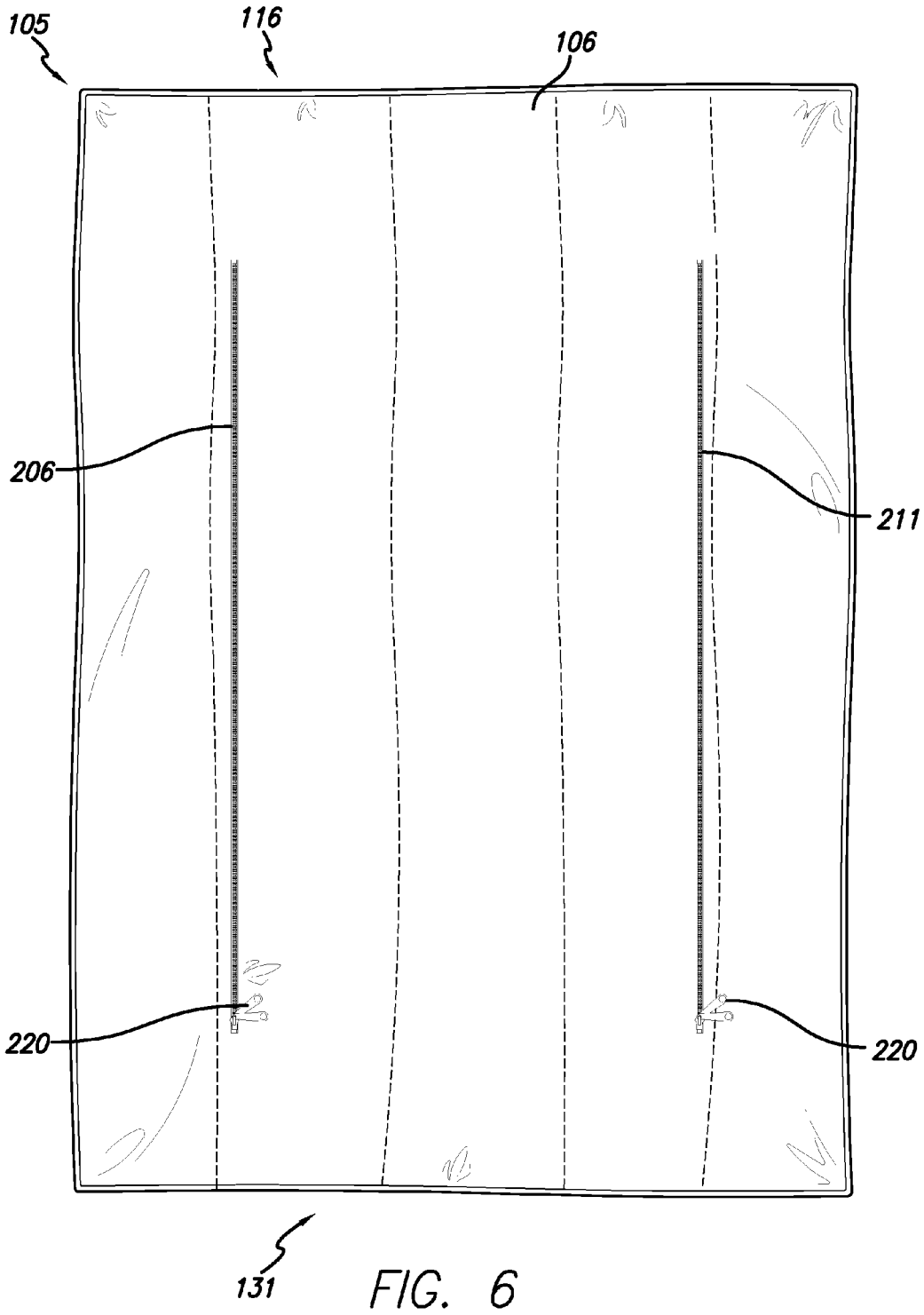
FIG. 6 is an underside view of the top layer of one embodiment of the bedding apparatus.

FIG. 6 is an underside view of the top layer of one embodiment of the bedding apparatus. The bottom layer of the bedding apparatus is not shown in FIG. 6. As shown in FIG. 6, the inner surface 106, or underside, of top layer 105 has top rails 206 and 211 that run along an interior of the sides of top layer 105 and do not go all the way to the top end 116 or the bottom end 131 of the top layer 105. Importantly, this interior placement of the top rails 206 and 211, which are interior from the two side ends of top layer 105, allows the bedding to conceal the zippers when the bedding apparatus is assembled, zipped up, or made up. Top end 116 of top layer 105 preferably extends to, but not beyond, top edge 115 (not shown in FIG. 6). The side ends and bottom end 131 of top layer 105 extend beyond and hang over side edges 120 and 125 and bottom edge 130 (not shown in FIG. 6).

The zipper top rails 206 and 211 stop short of the bottom edge 130 of the top layer 105, so as to allow a user's feet to be free. The zipper top rails 206 and 211 also stop short of the top edge 115 of the top layer 105, so as to allow a user's head to be free. The placement of the zipper top rails 206 and 211 allows the ends of the top layer 105 to fall over the edges of the bed mattress. The double headed zipper tabs 220 preferably stay with the top layer 105 when the top layer 105 is completely separated from bottom layer 110 (not shown in FIG. 6).

The components, steps, features, objectives, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objectives, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

Nothing that has been stated or illustrated is intended or should be interpreted to cause a dedication of any component, step, feature, objective, benefit, advantage, or equivalent to the public, regardless of whether it is recited in the claims.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents.

The invention claimed is:

1. A bedding apparatus, comprising:

a top layer;

a bottom layer; and two zippers;

wherein said bottom layer is comprised of a fitted portion and a top portion;

wherein said top portion of said bottom layer covers a top of a mattress;

wherein said fitted portion of said bottom layer fits tightly around the sides of said mattress;

wherein said top layer extends over and beyond one or more edges of said top portion of said bottom layer;

wherein each of said two zippers have a top slide rail and a bottom slide rail;

wherein said top slide rail of said two zippers are attached to a bottom of said top layer;

wherein said bottom slide rail of said two zippers are attached to an outer surface of said top portion of said bottom layer;

wherein said bottom slide rails of said two zippers are essentially parallel and are located at two opposing side edges of said top portion of said bottom layer;

wherein said two top slide rails of said two zippers are essentially parallel and are located interior from two opposing side ends of said bottom of said top layer so as to line up with and matingly engage with said bottom slide rails at said two opposing side edges of said top portion of said bottom layer;

wherein said two zippers are double-headed;

wherein said top layer and said bottom layer each have a foot edge and wherein said foot edge of said top layer and said foot edge of said bottom layer do not have attachment devices and do not matingly engage along said foot edges;

wherein said two bottom slide rails of said two zippers extend to said foot edge of said bottom layer;

wherein said two bottom slide rails of said two zippers do not extend to a head edge of said bottom layer, wherein said two top slide rails of said two zippers do not extend to said foot edge of said top portion and wherein said two top slide rails of said two zippers do not extend to a head edge of said top portion, wherein said top slide rails and said bottom slide rails of said zippers have a distal side and a proximal side, and wherein said proximal side has a lining that prevents contact with a plurality of teeth of said zippers.

2. The bedding apparatus of claim 1, wherein said top layer is a lined comforter.

3. The bedding apparatus of claim 1, wherein said top layer is a lined blanket.

4. The bedding apparatus of claim 1, wherein said top layer is a blanket.

5. The bedding apparatus of claim 1, wherein said top layer is a comforter.

6. The bedding apparatus of claim 1, wherein said top portion of said bottom layer is padded.

7. The bedding apparatus of claim 1, wherein said bedding apparatus looks like conventional bedding when assembled and made up.

* * * * *